US008448803B2

(12) United States Patent
Most

(10) Patent No.: US 8,448,803 B2
(45) Date of Patent: May 28, 2013

(54) FOOT ACTUATED DOOR OPENER FOR WASTE RECEPTACLE

(75) Inventor: Lynn W. Most, Lakeland, MN (US)

(73) Assignee: Most Dynamic Corporation, Lakeland, MN (US)

( * ) Notice: Subject to any disclaimer, the term of this patent is extended or adjusted under 35 U.S.C. 154(b) by 276 days.

(21) Appl. No.: 12/784,145

(22) Filed: May 20, 2010

(65) Prior Publication Data

US 2011/0120997 A1 May 26, 2011

Related U.S. Application Data

(60) Provisional application No. 61/180,000, filed on May 20, 2009.

(51) Int. Cl.
*B65D 43/26* (2006.01)

(52) U.S. Cl.
USPC ..... 220/263; 220/260; 220/825; 220/826; 248/147

(58) Field of Classification Search
USPC ..... 220/262, 263, 23.8, 345, 810, 264, 220/908, 909, 35, 825, 826, 495.09, 495.11, 220/694; 248/147, 101; D8/330, 307; 241/100; D34/7, 8.9, 10, 11; 312/319, 211, 212; 292/255, 292/226.3, 174, DIG. 25; 280/47.26
See application file for complete search history.

(56) References Cited

U.S. PATENT DOCUMENTS 816,886 A * 4/1906 Shonnard ..... 422/301
1,763,756 A 6/1930 Casapollo
2,071,486 A 2/1937 Wright
2,456,840 A 12/1948 Rogers et al.
2,533,524 A 12/1950 Snider
3,249,294 A 5/1966 Hughes
3,347,507 A * 10/1967 Dyer ..... 248/147
3,799,430 A 3/1974 Huguenin
4,609,122 A 9/1986 Ziegenbein
4,729,490 A 3/1988 Ziegenbein
4,892,218 A * 1/1990 Reiling ..... 220/263
4,907,715 A 3/1990 Bloomer (Continued)

FOREIGN PATENT DOCUMENTS

EP 426956 A1 * 5/1991

OTHER PUBLICATIONS

Trash Can Depot; www.trashcandepot.com/autokan-touchless-automatic-wood-food-service-trash-can-2; Apr. 6, 2009, 1 page.

(Continued)

*Primary Examiner* — Mickey Yu
*Assistant Examiner* — Gideon Weinerth
(74) *Attorney, Agent, or Firm* — Merchant & Gould P.C.

(57) ABSTRACT

A foot actuated door opener for a waste receptacle includes a foot pedal, a door position adjustment device, and a force transfer device. The foot pedal is coupled to the waste receptacle. The door position adjustment device is coupled to a pivoting door of the waste receptacle to move the door between a closed position and an open position. The force transfer device is connected to an exterior of the waste receptacle to transfer a force applied to the foot pedal to the door position adjustment device to move the door from the closed position to the open position. A foot actuated door opener kit, a waste receptacle, and methods of installing and using the same are also disclosed.

4 Claims, 15 Drawing Sheets

U.S. PATENT DOCUMENTS

| | | | | |
|---|---|---|---|---|
| 5,011,026 | A | 4/1991 | Hausman et al. | |
| 5,048,712 | A | 9/1991 | Wolters | |
| 5,090,785 | A * | 2/1992 | Stamp | 312/319.9 |
| 5,147,056 | A * | 9/1992 | Ma | 220/263 |
| 5,163,574 | A * | 11/1992 | Sosan | 220/264 |
| 5,367,959 | A | 11/1994 | Allen et al. | |
| 5,372,271 | A * | 12/1994 | Miller et al. | 220/263 |
| 5,398,374 | A | 3/1995 | Betancourt | |
| 5,538,338 | A * | 7/1996 | Biggers | 312/319.9 |
| D377,553 | S | 1/1997 | Cozart | |
| D383,278 | S | 9/1997 | Jennings | |
| 5,884,502 | A | 3/1999 | Jones et al. | |
| 5,901,872 | A | 5/1999 | Zollinhofer et al. | |
| 6,000,569 | A * | 12/1999 | Liu | 220/263 |
| 6,000,938 | A | 12/1999 | Melanowicz | |
| D423,165 | S | 4/2000 | Ragot | |
| 6,179,151 | B1 | 1/2001 | Radvansky | |
| 6,209,744 | B1 * | 4/2001 | Gill | 220/263 |
| 6,267,260 | B1 | 7/2001 | Lyons | |
| D446,373 | S | 8/2001 | Weiss et al. | |
| 6,293,409 | B1 | 9/2001 | Aykin | |
| 6,390,321 | B1 | 5/2002 | Wang | |
| D467,697 | S | 12/2002 | Spadafora | |
| 6,626,317 | B2 * | 9/2003 | Pfiefer et al. | 220/263 |
| 6,626,318 | B2 | 9/2003 | Salcedo | |
| D522,838 | S | 6/2006 | Bruce | |
| 7,070,064 | B1 * | 7/2006 | Henry et al. | 220/262 |
| 7,114,629 | B2 | 10/2006 | Panek | |
| D535,453 | S | 1/2007 | Japuntich et al. | |
| 7,195,185 | B2 | 3/2007 | Matlin | |
| D542,999 | S | 5/2007 | Japuntich et al. | |
| D551,345 | S | 9/2007 | Japuntich et al. | |
| 7,364,049 | B2 | 4/2008 | Panek | |
| 7,530,578 | B2 | 5/2009 | Niemeyer et al. | |
| 7,594,506 | B2 | 9/2009 | Lundberg | |
| 7,604,187 | B1 | 10/2009 | Lo | |
| 7,611,009 | B2 | 11/2009 | Youngs | |
| D619,320 | S | 7/2010 | Freire et al. | |
| D619,321 | S | 7/2010 | Freire et al. | |
| D619,322 | S | 7/2010 | Freire et al. | |
| 7,784,167 | B2 | 8/2010 | Panek | |
| 7,878,358 | B2 * | 2/2011 | Smudde | 220/23.88 |
| 7,922,024 | B2 * | 4/2011 | Yang et al. | 220/264 |
| 2009/0250463 | A1 * | 10/2009 | Van Risseghem et al. | 220/263 |

OTHER PUBLICATIONS

Photographs of an experimental installation at a Burger King, Nov. 1993, 1 page.

* cited by examiner

FOOT ACTUATED DOOR OPENER FOR WASTE RECEPTACLE

CROSS REFERENCE TO RELATED APPLICATIONS

This application claims priority to U.S. Provisional Application Ser. No. 61/180,000, filed on May 20, 2009, entitled WASTE RECEPTACLE WITH FOOT ACTUATED DOOR OPENER, the disclosure of which is incorporated by reference herein in its entirety.

BACKGROUND

Waste receptacles are used in many locations to temporarily store trash before the trash is transferred to a larger dumpster or other waste storage location. One type of waste receptacle is generally rectangular in shape having six sides, including a top, bottom, left, right, front, and back. The front includes a hinged door that is normally closed to contain the waste inside of the waste receptacle and reduce odors and the spread of surface and airborne viruses and bacteria. Another type of waste receptacle is also generally rectangular in shape, and includes an opening in the top for receiving waste items. This type of waste receptacle does not typically include a door or other covering across the opening. Waste receptacles are also known as waste cabinets, waste containers, or waste bins.

SUMMARY

In general terms, this disclosure is directed to a foot operated door opener for a waste receptacle that permits hands-free operation.

One aspect is a foot actuated door opener for a waste receptacle, the waste receptacle including an opening therein. The door opener includes a foot pedal, a door position adjustment device, and a force transfer device. The foot pedal is coupled to the waste receptacle. The door position adjustment device is coupled to the door. The door is pivotally connected to the waste receptacle. The door position adjustment device is configured to move the door between a closed position and an open position. The door covers at least a portion of the opening when the door is in the closed position. The force transfer device is connected to an exterior of the waste receptacle to transfer a force applied to the foot pedal to the door position adjustment device to move the door from the closed position to the open position.

Another aspect is a foot actuated door opener kit for assembly with a waste receptacle. The kit includes a foot pedal; a door position adjustment device; and a force transfer device, the force transfer device arranged and configured to be connected to the exterior of the waste receptacle, wherein when assembled, the force transfer device is connected between the foot pedal and the door position adjustment device to transfer a force from the foot pedal to the door position adjustment device to move the door from a closed position to an open position.

Yet another aspect is a method of installing a foot actuated door opener to a waste receptacle, the waste receptacle having an opening, the method comprising: pivotally connecting a foot pedal to the waste receptacle such that at least a portion of the foot pedal is located outside of the waste receptacle; connecting a door position adjustment device to a pivoting door, the door being positioned to at least partially cover the opening; and connecting a force transfer device to the waste receptacle and between the foot pedal and the door position adjustment device such that at least a portion of the force transfer device is arranged outside of the waste receptacle; and enclosing at least the portion of the force transfer device that is arranged outside of the waste receptacle with a housing.

A further aspect is a waste receptacle including a plurality of sides, a door, and a foot actuated door opener. The plurality of sides are arranged to define an interior space, wherein at least one of the sides includes an opening therein for receiving waste items. The sides have interior surfaces adjacent the interior space and exterior surfaces. A door is pivotally connected to at least one of the sides and positioned to at least partially cover the opening when in a closed position. The foot actuated door opener includes a foot pedal, a door position adjustment device, and a force transfer device. The foot pedal is coupled to at least one of the sides. The door position adjustment device is coupled to the door and configured to move the door between the closed position and an open position. The force transfer device is connected to an exterior of at least one of the sides to transfer a force applied to the foot pedal to the door position adjustment device to move the door from the closed position to the open position.

DETAILED DESCRIPTION

Figure 1:
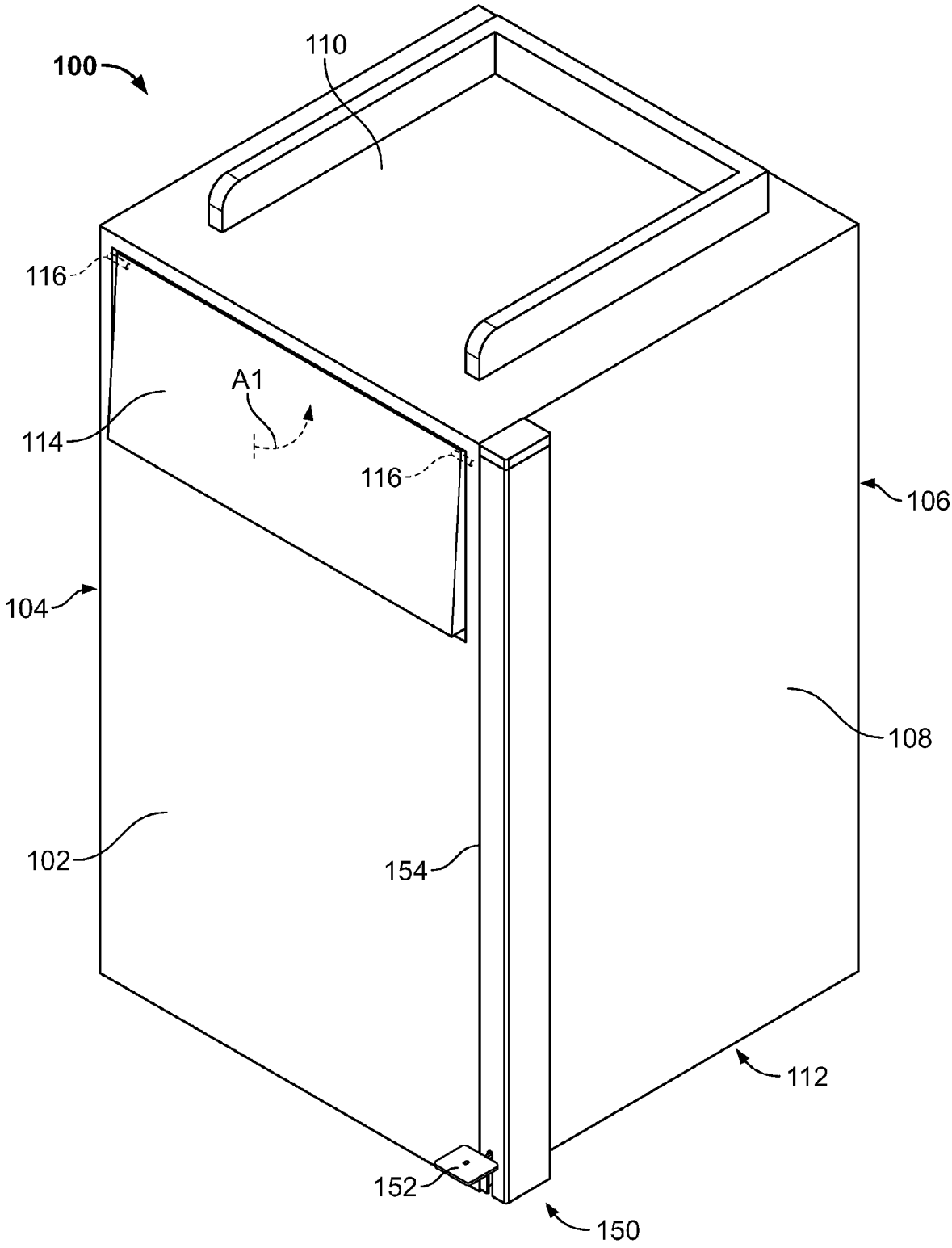
FIG. 1 is a schematic perspective view of an example waste receptacle.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is schematic perspective view of an example waste receptacle 100. In this example, waste receptacle 100 includes six sides having a front side 102, left side 104, rear side 106, right side 108, top side 110, and bottom side 112. The sides are connected together to form a three-dimensional rectangular structure. Inside of waste receptacle 100 is an internal volume defined by the internal surfaces of the sides. Front side 102 is typically hinged so that it can be opened to access the internal volume. A waste basket (not shown) can be housed inside of waste receptacle 100. Front side 102 also includes a hinged door 114. The hinged door is normally closed (e.g., generally aligned with front side 102), but can be pivoted about hinge 116 in the direction A1 to an open position. When hinged door 114 is in the open position, a user can access the internal volume to deposit trash into the waste basket contained therein. To make cleanup easier, a liner is placed inside of the waste basket in some embodiments. In some embodiments top side 110 is configured to store stacked trays thereon.

Waste receptacle 100 further includes door opener 150 including a foot pedal 152 and housing 154. Although hinged door 114 can still be opened manually, if desired, by pressing on the front of hinged door 114, door opener 150 also allows hinged door 114 to be foot actuated for hands-free operation.

The door opener 150 includes a foot pedal 152. To open hinged door 114, a force is applied to the pedal by stepping on the pedal. The force is transferred through the door opener and to a rear side of the hinged door 114. The force causes door opener 150 to pivot about hinge 116 in the direction A1 until the hinged door 114 reaches the open position. Trash can then be easily discarded into a waste basket contained therein. Once the user has finished, the force is removed from foot pedal 152, allowing gravity (or a force from a spring, hydraulic, or other device) to return the hinged door to the closed position.

Figure 2:
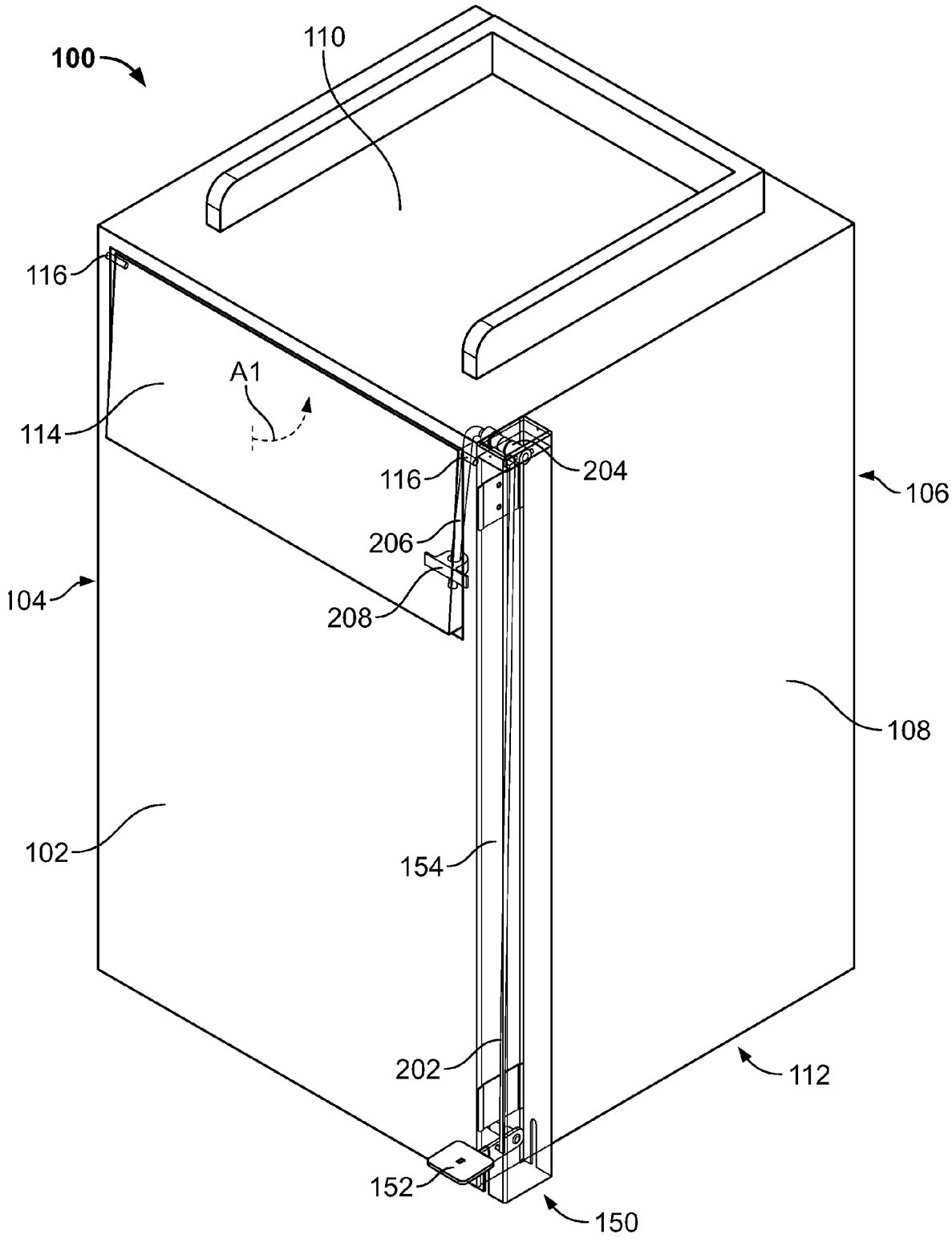
FIG. 2 is another schematic perspective view of the example waste receptacle shown in FIG. 1 in which portions of the waste receptacle are partially transparent to permit viewing of interior components.

FIG. 2 is a schematic and partially transparent perspective view of the example waste receptacle 100. As explained above, waste receptacle 100 includes door opener 150 including foot pedal 152 and housing 154. As can be further seen in FIG. 2, the example door opener 150 also includes a force transfer device 202, coupling 204, arm 206, and door connection bracket 208.

In some embodiments foot pedal 152 is pivotally connected to and supported by a side of waste receptacle 100 and is arranged near bottom side 112. In this example, foot pedal 152 is supported by right side 108. Foot pedal 152 is configured to be spaced slightly from the floor so that foot pedal 152 can move downward when a downward force is applied to it. Preferably the pedal 152 extends out from either the left or right sides 104 or 108 (shown from the right side 108 in FIG. 2) and flush to front side 102. Foot pedal 152 can also extend out or be recessed from sides 104 or 108 in other embodiments, e.g. as described in conjunction with the embodiment shown in FIG. 9.

Force transfer device 202 is a device that is configured to transfer a force from foot pedal 152 through at least part of door opener 150. In this example, force transfer device 202 is connected at one end to foot pedal 152 and includes a coupler 204 at the other end. In some embodiments, the force transfer device 202 includes a cable, a rope, a chain, a wire, or other flexible or non-flexible elongate members that are configured to transfer a force axially along its length. Further, some embodiments include multiple force transfer devices connected together.

Additionally, it has been found that the addition of a spring as a part of the force transfer device provides improved operation. For example, some embodiments of the force transfer device 202 include a spring. The spring is connected between the foot pedal and another force transfer device (e.g., cable, rope, chain, wire, etc.) or between the coupling 204 and the other force transfer device. The spring provides a more gradual force transfer from the foot pedal to the hinged door 114. In addition, the force transfer device 202 can be configured so that the spring is pre-loaded with a relatively light force to remove slack from the force transfer device and to reduce the amount of force that must be applied to foot pedal 152 to open hinged door 114.

Force transfer device 202 is typically connected to arm 206 by coupler 204. Coupler 204 is connected to arm 206. When foot pedal 152 is depressed, force is transferred through force transfer device 202 and to coupler 204. The force on coupler 204 causes coupler 204 to rotate. The rotation of coupler 204 is transferred to arm 206. Coupler 204 is described in more detail below with reference to FIG. 5. In other embodiments, coupler 204 is not included and force transfer device 202 is directly connected to arm 206 or another device. In some embodiments the force transfer device 202 includes coupler 204.

Arm 206 is pivotally connected to and supported by a side of waste receptacle 100. In this example, arm 206 is pivotally connected to and supported by right side 108. Arm 206 is connected to coupler 204 and is arranged and configured to open and close hinged door 114 with the rotation of coupler 204. In this example, arm 206 is a rod having a right-angled bend. In addition, arm 206 includes a stop at a distal end of arm 206 for completely disengaging with door connection bracket 208. One example of a stop is a second right-angled bend formed at the distal end of arm 206. Another example of a stop is a nut screwed onto a threaded distal end of arm 206. When foot pedal 152 is depressed, a first portion of arm 206 rotates. The rotation causes the second portion of arm 206 to swing in the direction of arrow A1. The arm configuration will allow the hinged door to swing freely or be stopped from swinging out beyond the resting position, i.e. the closed position, of the hinged door.

Door connection bracket 208 is connected to an interior side of hinged door 114 and coupled to the second portion of arm 206. When the second portion of arm 206 swings, the force is applied to the door connection bracket 208, which pulls hinged door 114 with it until hinged door 114 is opened.

Arm 206 and door connection bracket 208 are an example of a door position adjustment device that is operable to move door 114 between the closed position shown in FIG. 2 and the open position. Other embodiments include other door position adjustment devices, such as those discussed herein.

Housing 154 is arranged around at least portions of foot pedal 152, force transfer device 202, coupling 204, and arm 206 to enclose these components. Housing 154 provides a clean appearance and protects the components from wear and tampering. In addition, housing 154 protects users from accidental contact with these components.

Figure 3:
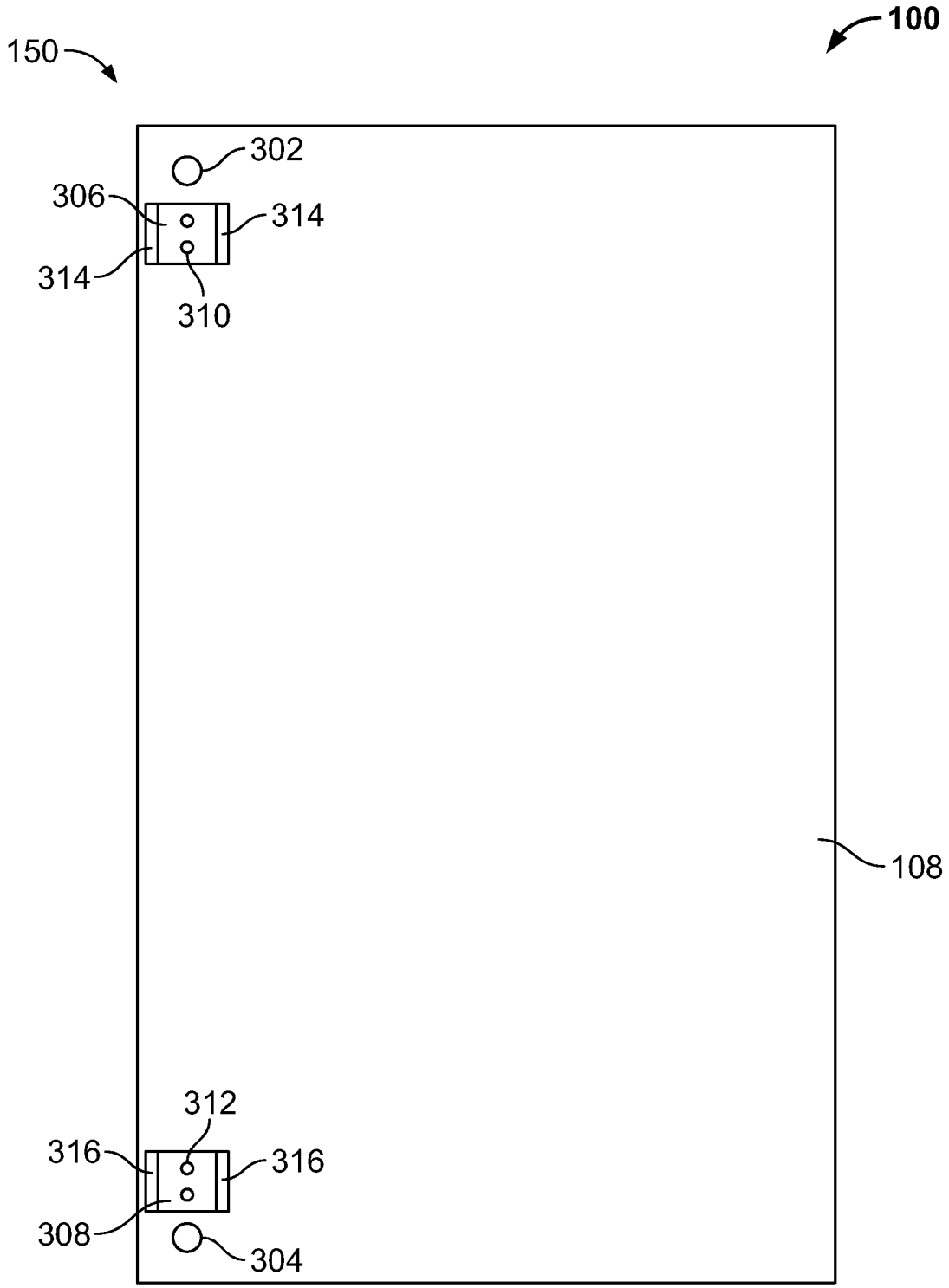
FIG. 3 is a schematic right side view of the example waste receptacle shown in FIG. 1.

FIG. 3 is a schematic right side view of the example waste receptacle 100. Although the example waste receptacle 100 is illustrated and described as having the door opener 150 connected to a right side 108 of waste receptacle 100, some embodiments are designed so that they can be connected to either the left side 104 or the right side 108. In this way, a single door opener can be purchased regardless of whether left or right side installation is desired. One reason that it is useful to connect door opener to either side is that waste receptacle 100 can be arranged next to another waste receptacle 100. In this configuration, it is sometimes desirable to have the door openers 150 located on opposite sides so that waste receptacles 100 do not have to have one or both of the door openers 150 between them.

FIG. 3 illustrates additional components of door opener 150 and shows an example of the mounting of door opener 150 to a side 108 of the waste receptacle 100. In some embodiments, door opener 150 is a kit that is configured to be installed on existing waste receptacles. In other embodiments the door opener 150 is manufactured along with the rest of waste receptacle 100 and sold as a complete unit.

To install door opener 150, apertures 302 and 304 are drilled into right side 108 (or 104), near to front side 102 (shown in FIGS. 1 and 2). Apertures 302 and 304 are generally vertically aligned with each other. Brackets 306 and 308 are then arranged adjacent to and vertically aligned with apertures 302. The brackets 306 and 308 are typically connected to right side 108 (or left side 104) with fasteners 310 and 312, such as screws, nails, bolts and nuts, adhesive, or other fasteners.

As described in more detail below, aperture 302 is provided in side 108 to support a first portion of arm 206, while allowing the first portion of arm 206 freedom to rotate. Aperture 304 is provided in side 108 to support foot pedal 152 (which may be connected to aperture 304 with another arm or device if desired, such as a spacer and fastener, a rod, or other bracket). In other possible embodiments foot pedal 152 is connected by another fastener or device to sidewall 108 or housing 154 (shown in FIGS. 1-2), such that aperture 304 is not necessary.

Brackets 306 and 308 are provided to support housing 154 in the position and orientation illustrated in FIGS. 1 and 2 and as described in more detail below with reference to FIG. 4. In some embodiments bracket 306 includes a body having side flanges 314 and bracket 308 includes a body having side flanges 316. Flanges 314 and 316 engage with portions of housing 154 (shown in FIGS. 1-2). One or more brackets 306 and 308 are used in some embodiments. Other embodiments include other fasteners or devices to connect housing with right side 108 (or left side 104). Some configurations do not require brackets 306 and 308 to attach housing 154.

Figure 4:
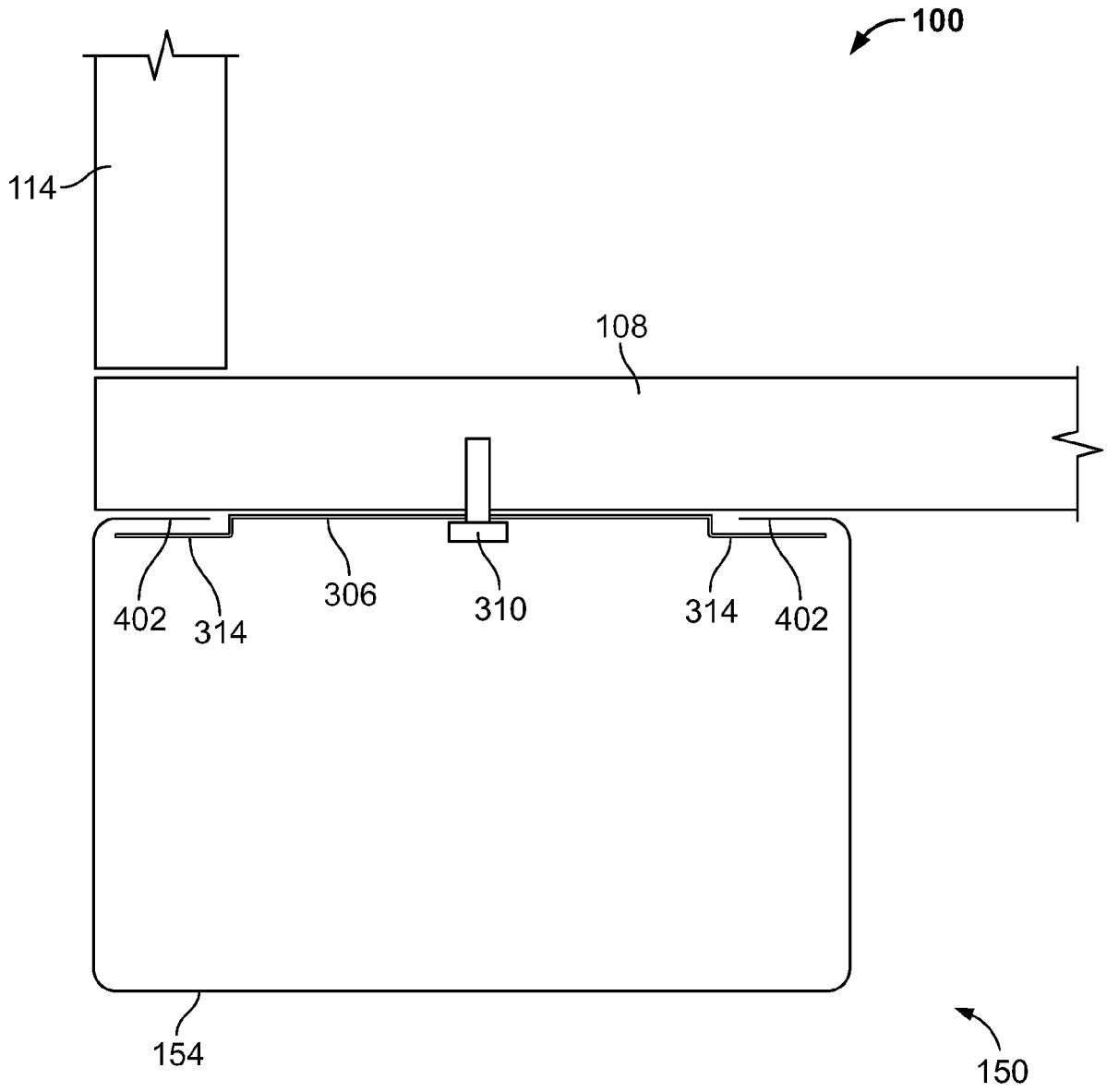
FIG. 4 is a schematic cross-sectional view of a portion of the example waste receptacle shown in FIG. 1.

FIG. 4 is a schematic cross-sectional view of a portion of the example waste receptacle 100. In this example, portions of waste receptacle 100 include hinged door 114 of front side 102, right side 108, and door opener 150. Door opener 150 includes housing 154, bracket 306, and fastener 310. Bracket 306 includes flanges 314. Other portions of door opener 150 are not shown in FIG. 4 for clarity (such as the foot pedal and force transfer devices shown in FIG. 2).

As discussed above, bracket 306 is connected to right side 108, such as using one or more fasteners 310. The bracket 306 is preferably arranged so that flanges 314 extend out to each side of bracket 306. After all other components of door opener 150 have been installed onto waste receptacle 100, housing 154 is then installed. In some embodiments housing 154 has three sidewalls connected at approximately right angles to form a "U" shape (or "C" shape). Housing 154 also includes spaced flanges 402 that are arranged generally parallel to the central sidewall on an opposite side of the housing and extend toward each other. Flanges 402 are sized to fit between flanges 314 of bracket 306 (and flanges 316 of bracket 308) and the exterior surface of right side 108 (or left side 104). Housing 154 is installed by sliding flanges 402 behind flanges 314 and 316 until housing 154 is in the desired position. Flanges 402 can also extend away from each other and be used to attach housing 154 directly to side 104 or 108 using a fastener, such as screws, nails, adhesives and the like. In this way the housing 154 shields and protects components of door opener 150 as well as people or objects nearby. Housing 154 is preferably made of sheet metal that is cut and bent into the configuration described herein. Other materials can also or alternatively be used, such as plastic, wood, laminated wood, and the like.

Figure 5:
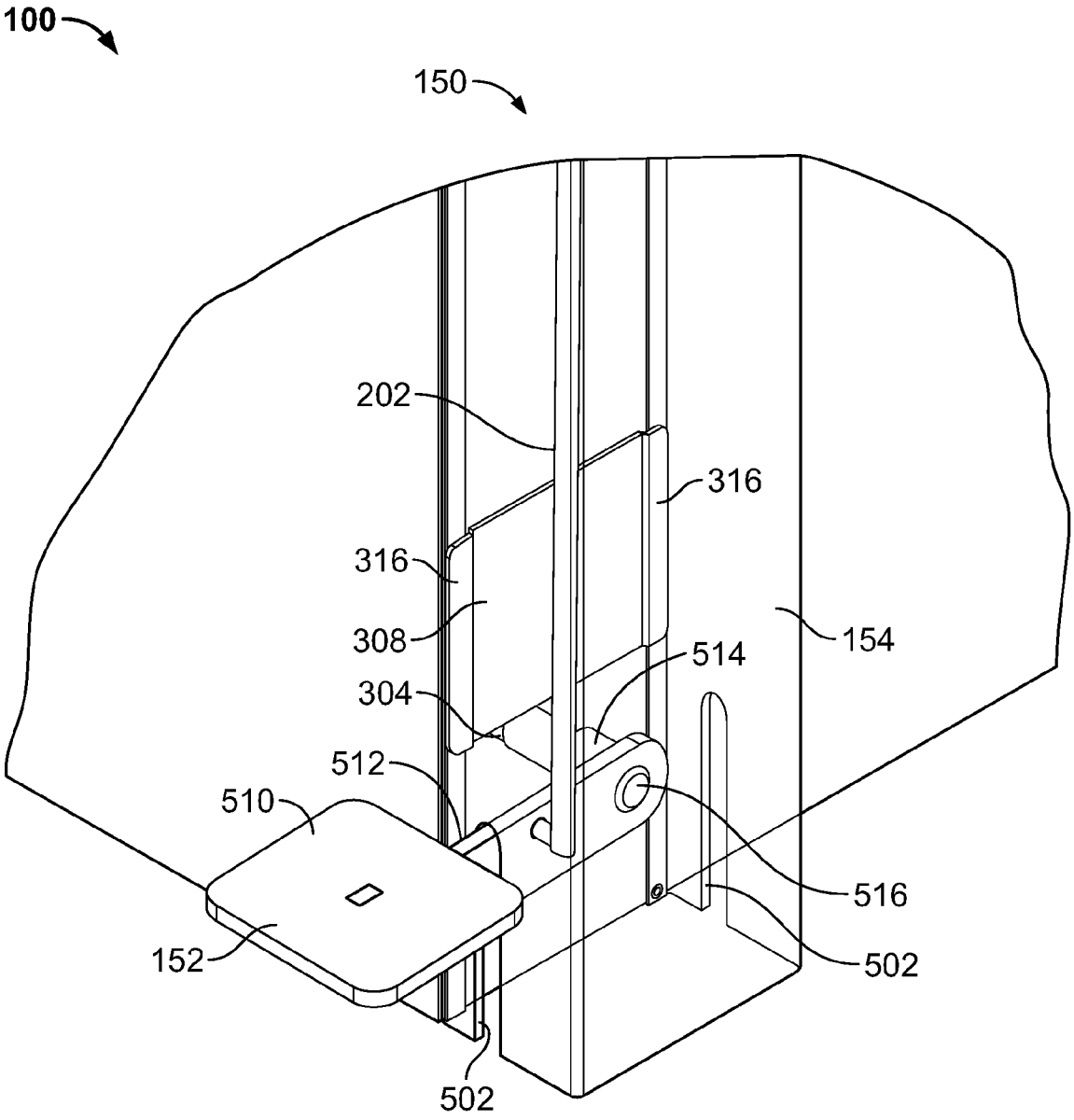
FIG. 5 is a schematic perspective view of another portion of the example waste receptacle shown in FIG. 1.

FIG. 5 is a schematic perspective view of a portion of waste receptacle 100 and door opener 150. As previously discussed, door opener 150 includes foot pedal 152, housing 154, bracket 308, and force transfer device 202.

In some embodiments housing 154 includes one or more vertical slots 502 at one end. The vertical slot 502 is sized to allow an arm 512 of foot pedal 152 to pass through. If vertical slots 502 are included on both sides of housing 154, the same housing 154 can be used regardless of whether door opener 150 is installed on the left side 104 or the right side 108 of waste receptacle 100. In some embodiments if waste receptacle 100 is elevated from a surface, such as by plinths, legs, casters or the like, a foot shield is attached (shown as 956 in FIG. 9) to prevent the operators foot from slipping under waste receptacle 100.

In this example, foot pedal 152 includes a plate 510, arm 512, spacer 514, and fastener 516. Plate 510 forms the contact portion of the foot pedal 152 where a person places a foot (or footware). Arm 512 is connected to plate 510 at one end and to spacer 514 at the other. When plate 510 is depressed, arm 512 pivots about an axis of spacer 514. Spacer 514 is connected to right side 108 (or left side 104) with one or more fasteners 516, such as a bolt and nut that pass through aperture 304. Washers or bearings are included in some embodiments to reduce friction between foot pedal 152 and aperture 304 or between spacer 514 and arm 512

When foot pedal 152 is depressed, force transfer device 202, which is connected to arm 512, is pulled downward, passing a force through the force transfer device 202.

The connection between housing 154 and bracket 308 is also illustrated in FIG. 5.

Figure 6:
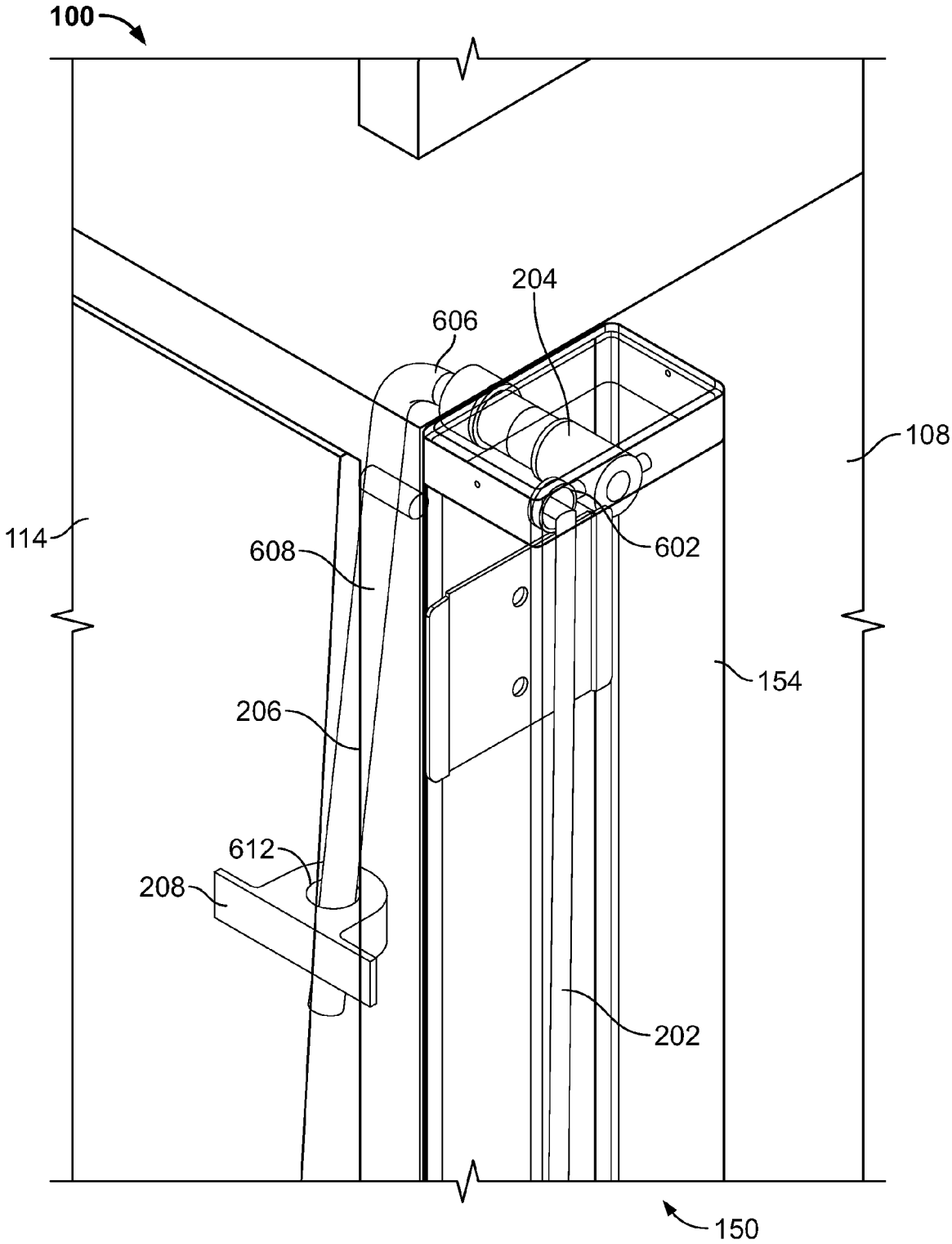
FIG. 6 is a schematic perspective view of another portion of the example waste receptacle shown in FIG. 1.

FIG. 6 is a schematic perspective view of a portion of waste receptacle 100 and door opener 150. In this example, door opener 150 includes housing 154, force transfer device 202, coupling 204, arm 206, and door connection bracket 208. Coupling 204 further includes eyelet fastener 602. Arm 206 includes first portion 606 and second portion 608.

As discussed above, when foot pedal 152 (shown in FIG. 5) is depressed, a force is transferred through force transfer device 202. The force is applied to coupling 204. In a more specific example, an end of force transfer device 202 is connected to coupling 204. The coupling converts the force from axial force to rotational force, such that coupling 204 is caused to rotate about a central axis.

First portion 606 is connected to coupling 204. In one example, first portion 606 includes a transverse aperture at a distal end. Eyelet fastener includes a pin portion that is sized to fit into the aperture. The pin portion can be secured to coupling 204 by bending ends of the pin portion (e.g., a cotter pin) or with a nut if coupling 204 is threaded. Other fastening devices can also be used. Since first portion 606 is connected to coupling 204, rotation of coupling 204 causes rotation of arm 206 about the axis of first portion 606. Coupling 204 can be rotated 180 degrees, flipped, or inverted for installation on left side 104 of waste receptacle 100, if desired.

When first portion 606 of arm 206 rotates, the force is transferred through arm 206 so that second portion 608 pivots about the axis of first portion 606. The force causes second portion 608 to pivot in the direction A1, shown in FIG. 2. Arm 206 is preferably made of metal, such as a metal rod that is bent to have an angled shape. However, other embodiments include other configurations of arm 206. Preferably the angle between first portion 606 and second portion 608 is in a range from about 85 degrees to about 110 degrees. In some embodiments, an additional bend is formed at a distal end of second portion 608 to reduce the chance of unintentional disengagement of arm 206 from door connection bracket 208.

Door connection bracket 208 is connected to an interior surface of hinged door 114 and includes a sliding bracket 612. Door connection bracket 208 can be made of any suitable material, such as metal or plastic and can be formed by suitable means such as molding or cutting, grinding, and drilling. Door connection bracket 208 can be connected to hinged door 114 by one or more fasteners, such as adhesive, double sided tape, screws, nails, bolt with nut or compression nut, or other fasteners. Door connection bracket 208 is connected to hinged door 114 at a location where arm 206 can reach and inserted through an aperture of sliding bracket 612.

When second portion 608 pivots, the second portion 608 pulls on door connection bracket 208 causing hinged door 114 to open. Second portion 608 is free to slide within sliding bracket 612.

The configuration of door opener 150 locates many components of door opener 150 off to the side of waste receptacle 100 where they do not interfere with the opening or closing of hinged door 114. In addition, coupling 204 is preferably arranged above and behind hinged door 114 so that it and second portion 608 similarly do not interfere with the opening of hinged door 114.

Figure 7:
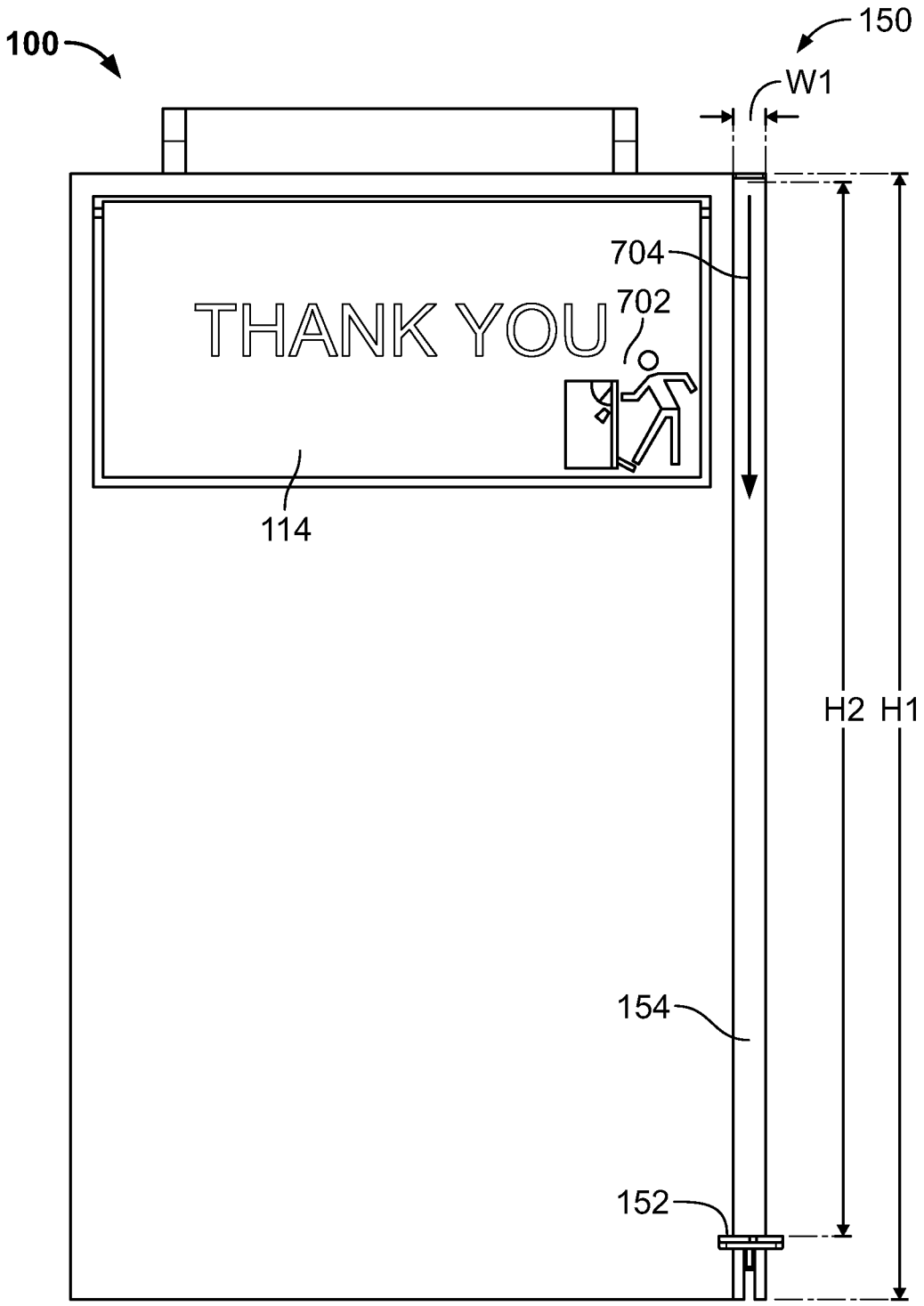
FIG. 7 is a schematic front view of the example waste receptacle shown in FIG. 1.

FIG. 7 is a schematic front view of example waste receptacle 100.

Exemplary dimensions of some embodiments of the waste receptacle 100 are described herein. Other embodiments will have other dimensions than the specific examples provided. H1 is the overall height of example waste receptacle 100. H1 is typically in a range from about 30 inches to about 45 inches. H2 is the distance from top side 110 of waste receptacle 100 to the top of foot pedal. H2 is typically in a range from about 25 inches to about 35 inches. W1 is the width of housing 154. W1 is typically in a range from about 0.5 inches to about 2 inches.

In some embodiments waste receptacle 100 includes features to educate users that waste receptacle 100 is configured for foot operation. For example, some embodiments include labels, stickers, or graphics applied to one or more surfaces of waste receptacle 100. In this example waste receptacle 100 includes a first graphic 702 that is provided on an exterior surface of hinged door 114 and a second graphic 704 that is provided on a front surface of housing 154. First graphic 702 includes a graphical depiction of a person depressing the foot pedal with the person's foot and discarding trash into the waste receptacle. Second graphic 704 is a downward pointing arrow that is directed toward foot pedal 152 to direct the person's attention to the presence of the foot pedal. Graphics can also be placed on other surfaces of waste receptacle 100 as desired.

Figure 8:
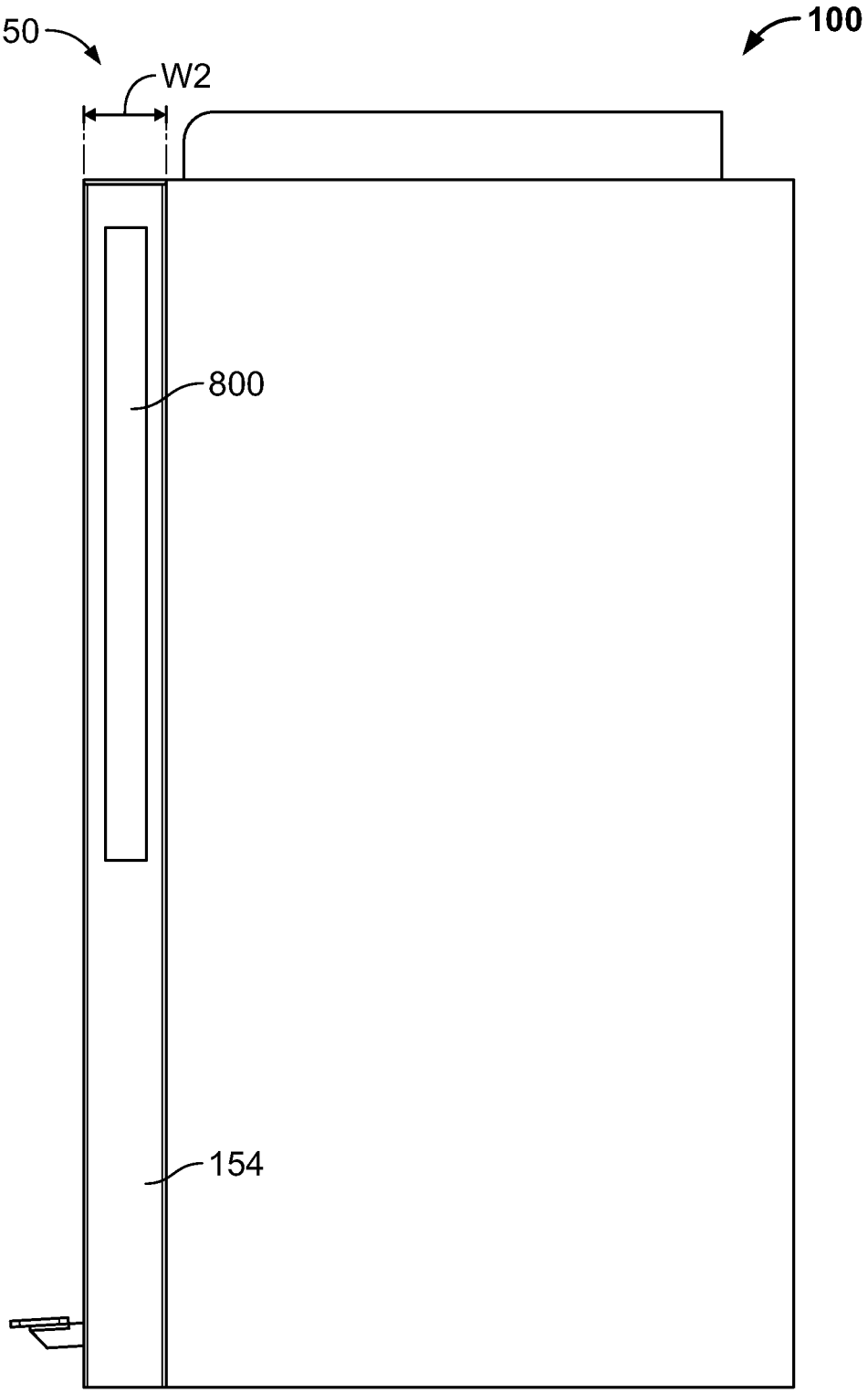
FIG. 8 is a schematic right side view of the example waste receptacle shown in FIG. 1.

FIG. 8 is a schematic right side view of the example waste receptacle 100.

W2 is another width of housing 154. W2 is typically in a range from about 1 inch to about 4 inches. Other embodiments include other dimensions.

In addition to educational graphics, other graphics are provided in some embodiments of waste receptacle 100. In this example, waste receptacle 100 includes advertising graphic 800. The advertising graphic 800 displays information about the company that makes or sells the waste receptacle 100 or door opener 150 or information about the waste receptacle 100 or door opener 150 themselves. Other embodiments include advertisements about other companies or products or any other symbols, letters, numbers, or graphical representations.

Figure 9:
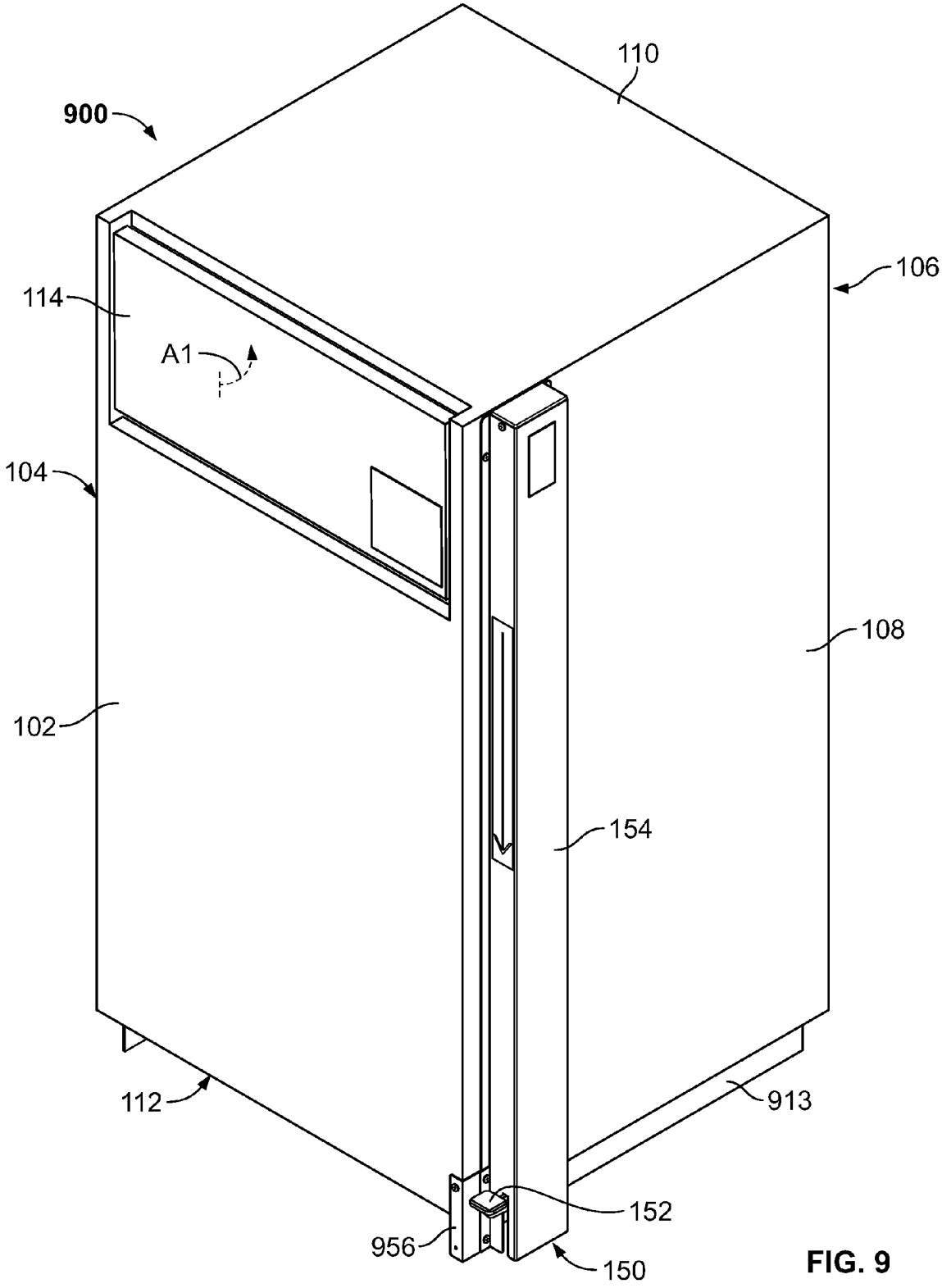
FIG. 9 is a schematic perspective view of another example waste receptacle.

FIG. 9 is schematic perspective view of another example waste receptacle 900. In this example, the basic structure and function of waste receptacle 900 is similar to waste receptacle 100 shown in FIGS. 1-8 and is, thus, not described in detail. Waste receptacle 900 includes six sides having a front side 102, left side 104, rear side 106, right side 108, top side 110, and bottom side 112. The sides are connected together to form a three-dimensional rectangular structure. In this example, the waste receptacle 900 includes an elevated platform 913 providing easier access to hinged door 114 and the internal volume. Front side 102 also includes a hinged door 114. The hinged door is normally closed (e.g., generally aligned with front side 102), but can be pivoted about a hinge (not visible in FIG. 9) in the direction A1 to an open position.

Waste receptacle 900 further includes door opener 150 including a foot pedal 152 and housing 154. Foot shield 956 spans a space defined by a lower portion of the waste receptacle 900 (e.g., the lower edge of front side 102 and/or a side 104/108) and a supporting surface (e.g., the floor or ground). In another embodiment, foot shield 956 is an integral part of one or more portions of waste receptacle 900, such as front side 102, sides 104/108 or elevated platform 913. Foot shield 956 is attached to waste receptacle 900 to prevent the operator's foot from slipping under receptacle 900.

Figure 10:
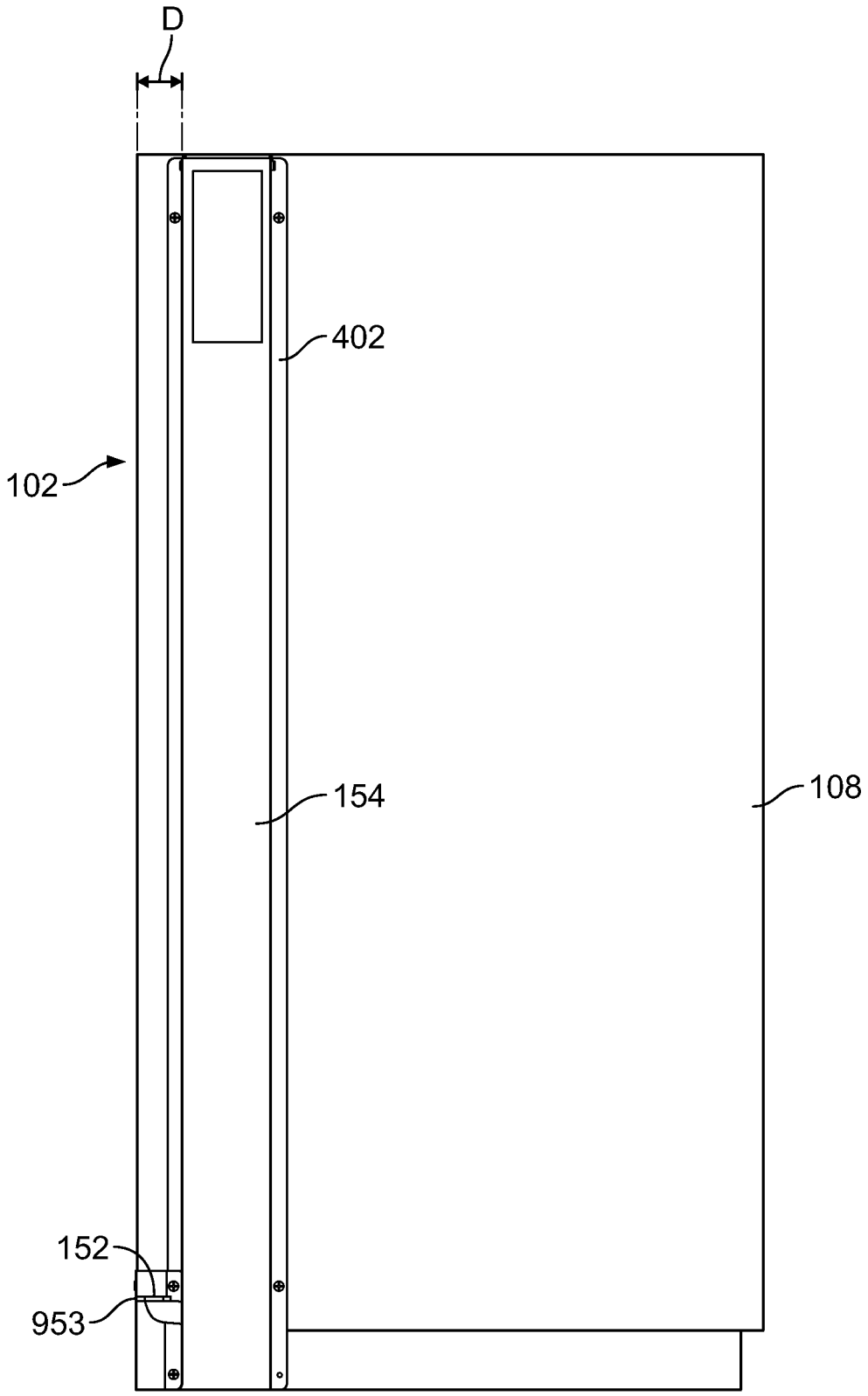
FIG. 10 is a schematic right side view of the example waste receptacle shown in FIG. 9.

FIG. 10 is a schematic right side view of the example waste receptacle 900.

In this example, foot pedal 152 is recessed a distance D from side 108 such that the front 953 of foot pedal 152 is aligned with side 102.

In some embodiment, housing 154 includes flanges 402 that extend away from each other and can be used to attach housing 154 directly to side 104 or 108 using a fastener, such as screws, nails, adhesives and the like. In this way the housing 154 shields and protects components of door opener 150 as well as people or objects nearby. Flanges 402 preferably extend along the length of housing 154, but can have different configurations and extend along portions of housing 154, in other embodiments. Housing 154 is preferably made of sheet metal that is cut and bent into the configuration described herein. Other materials can also or alternatively be used, such as plastic, wood, laminated wood, and the like.

Figure 11:
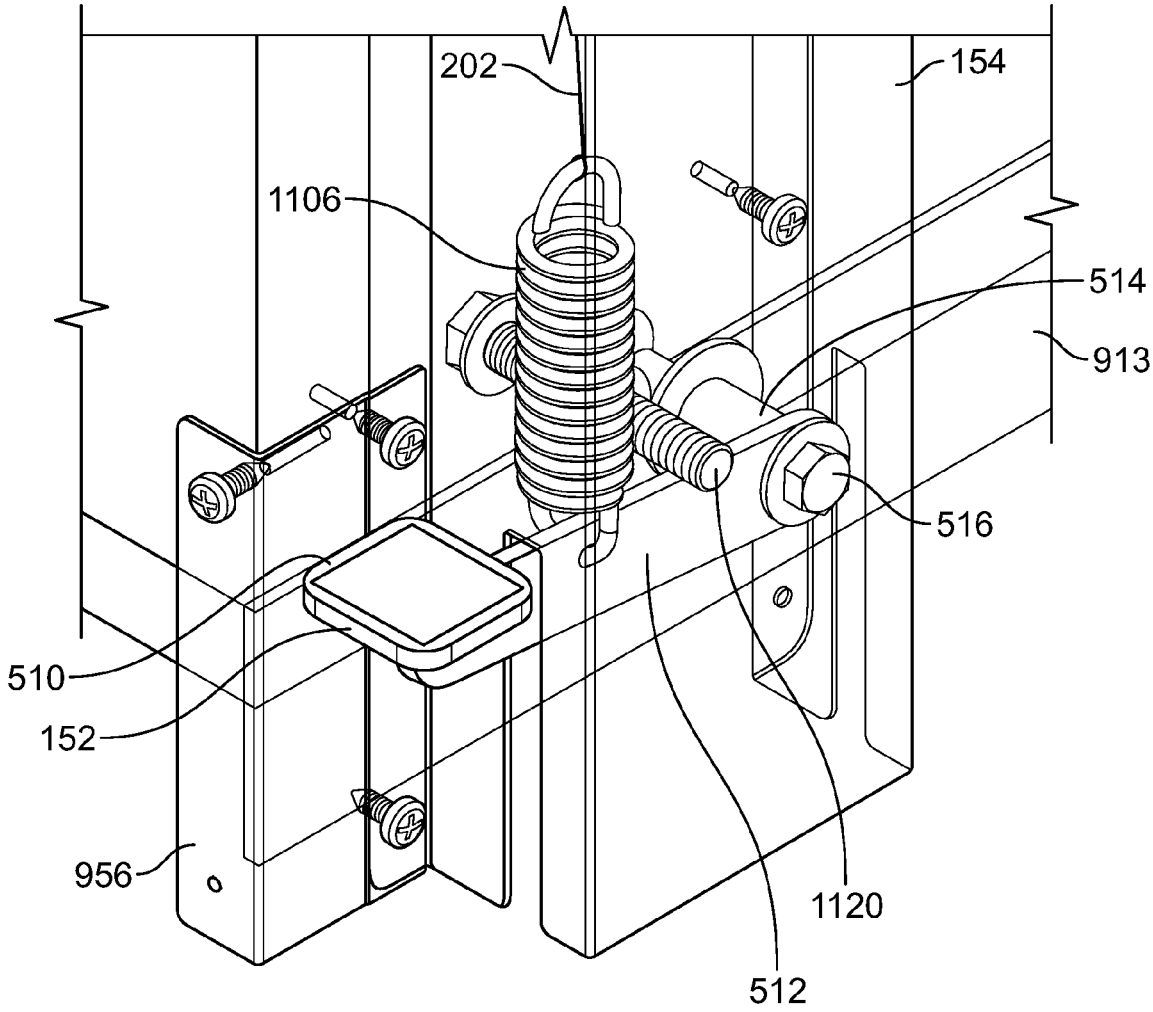
FIG. 11 is a schematic perspective view of a portion of the example waste receptacle shown in FIG. 9.

FIG. 11 is a schematic perspective view of a portion of the example waste receptacle 900 and door opener 150. As previously discussed, door opener 150 includes foot pedal 152, housing 154, and foot shield 956. The example door opener 150 also includes a force transfer device 202 and a stopper 1120.

In this example, foot pedal 152 includes a plate 510, arm 512, spacer 514, fastener 516, and stopper 1120.

Force transfer device 202 is a device that is configured to transfer a force from foot pedal 152 through at least part of door opener 150. In this example, spring 1106 is provided as a part of force transfer device 202 to improve operation. Spring 1106 is connected between the foot pedal 152 and force transfer device 202. Spring 1106 provides a more gradual force transfer from the foot pedal 152 to the hinged door 114. In addition, the force transfer device 202 can be configured so that the spring is pre-loaded with a relatively light force to remove slack from the force transfer device and to reduce the amount of force that must be applied to foot pedal 152 to open hinged door 114.

Stopper 1120 is arranged to limit the range of motion of foot pedal 152 and arm 512. For example, spring 1106 can be tensioned (along with force transfer device 202) to maintain a constant tension on foot pedal 152. When not in use, however, stopper 1120 is configured to prevent upward motion of foot pedal 152 beyond a certain rest position. In this example, stopper 1120 is a screw or bolt extending through a side 104/108 of waste receptacle 900 and above arm 512. When arm 512 pivots upward, the motion is limited upon contact with stopper 1120. A wide variety of alternative stopper assemblies are possible in other embodiments. For example, in some embodiments the movement of arm 512 is limited by housing 154.

Figure 12:
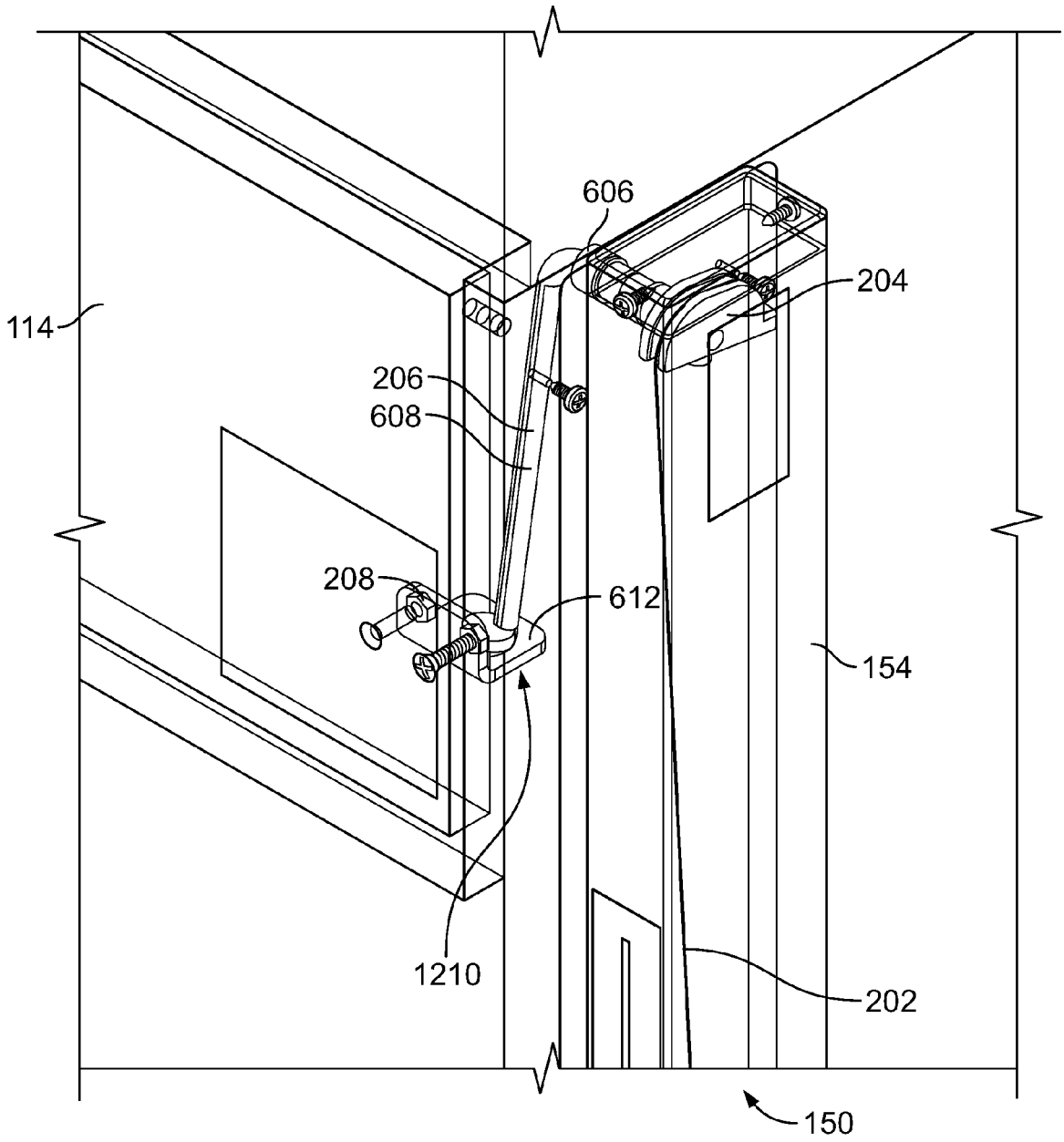
FIG. 12 is a schematic perspective view of another portion of the example waste receptacle shown in FIG. 9.

FIG. 12 is a schematic perspective view of another portion of the example waste receptacle 900 and door opener 150. Door opener 150 includes housing 154, force transfer device 202, coupling 204, arm 206, and door connection bracket 208. In this example, coupling 204 is a cam with a channel that receives a portion of force transfer device 202 therein. The combination of cam coupling 204 and the force transfer device 202 provide an interface with good resistance to wear with repeated use. In some embodiments, coupling 204 has a set screw on the back for attachment of force transfer device 202. Arm 206 includes first portion 606, second portion 608, and third portion 1210.

As discussed above, when foot pedal 152 is depressed, a force is transferred through force transfer device 202. The force is applied to coupling 204. The coupling converts the force from axial force to rotational force, such that coupling 204 is caused to rotate.

Door connection bracket 208 is connected to an interior surface of hinged door 114 and includes a sliding bracket 612. In this example, door connection bracket 208 is connected to hinged door 114 by screws, nails, bolt with nut or compression nut, or other fasteners. Door connection bracket 208 is connected to hinged door 114 at a location where arm 206 can be inserted through an aperture of sliding bracket 612.

Arm 206 and door connection bracket 208 are examples of a door position adjustment device for moving door 114 from a closed position to an open position, and from the open position to the closed position.

Third portion 1210 of the arm 206 is arranged on the other side of sliding bracket 612. Third portion 1210 is preferably bent in relation to second portion 608 in order to prevent arm 206 from sliding out from sliding bracket 612 when hinged door 114 is opened. In some embodiments third portion is provided with another configuration that prevents arm 206 from sliding out from bracket 612, such as a pin having a length slightly larger than the diameter of the aperture and being inserted through a aperture drilled at the end of third portion. Alternatively, the length of arm 206 is sufficiently long that it cannot come out of sliding bracket 612 during normal use. In yet another possible embodiment, another device is provided to limit movement of another portion of door opener 150, thereby preventing over rotation of arm 206 and disengagement with bracket 612.

Figure 13:
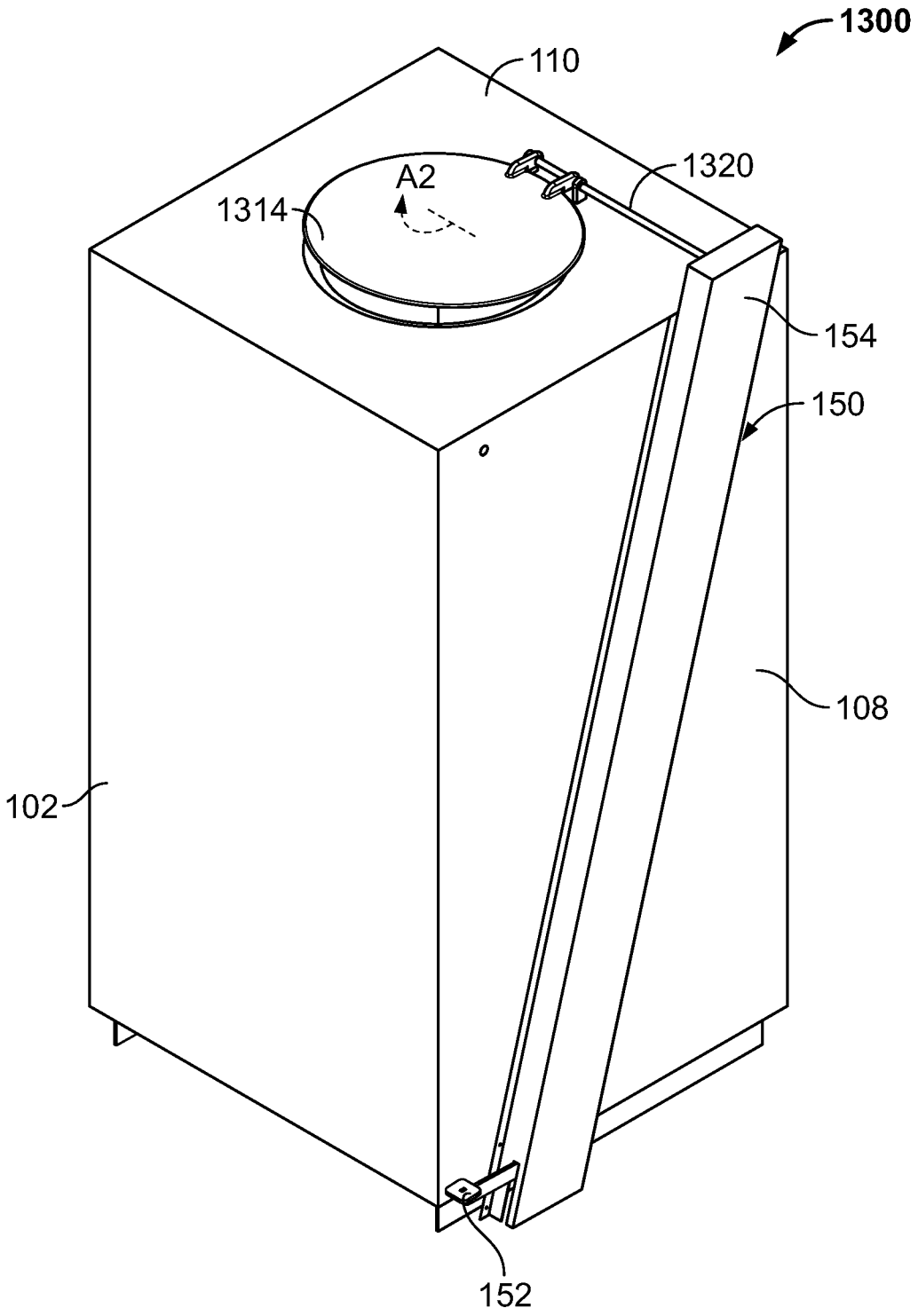
FIG. 13 is a schematic perspective view of another example waste receptacle.

FIG. 13 is schematic perspective view of another example waste receptacle 1300. In this example, the basic structure and function of waste receptacle 1300 is similar to waste receptacle 100 shown in FIGS. 1-8 and waste receptacle 900 shown in FIGS. 9-12 and, thus, such description is not repeated in detail herein. Waste receptacle 1300 includes, for example, six sides having a front side 102, left side 104, rear side 106, right side 108, top side 110, and bottom side 112. In this example of waste receptacle 1300, top side 110 includes an aperture allowing a user to access the internal volume to deposit trash into the waste basket contained therein. Top side 110 is further provided with hinged door 1314 which e.g., reduces the escape of odors etc. that can arise from the waste. The hinged door 1314 is normally closed (e.g., generally aligned with top side 110), but can be pivoted about an arm 1320 in the direction A2 to an open position.

Waste receptacle 1300 further includes door opener 150 including a foot pedal 152 and housing 154. In this example, arm 1320 is mounted to the rear side of hinged door 1314 and, thus, at a rear portion of top side 110. Door opener 150 is, therefore, arranged in a tilted position to allow an operator easy access to foot pedal 152 at the front side 102 of receptacle 1300.

Figure 14:
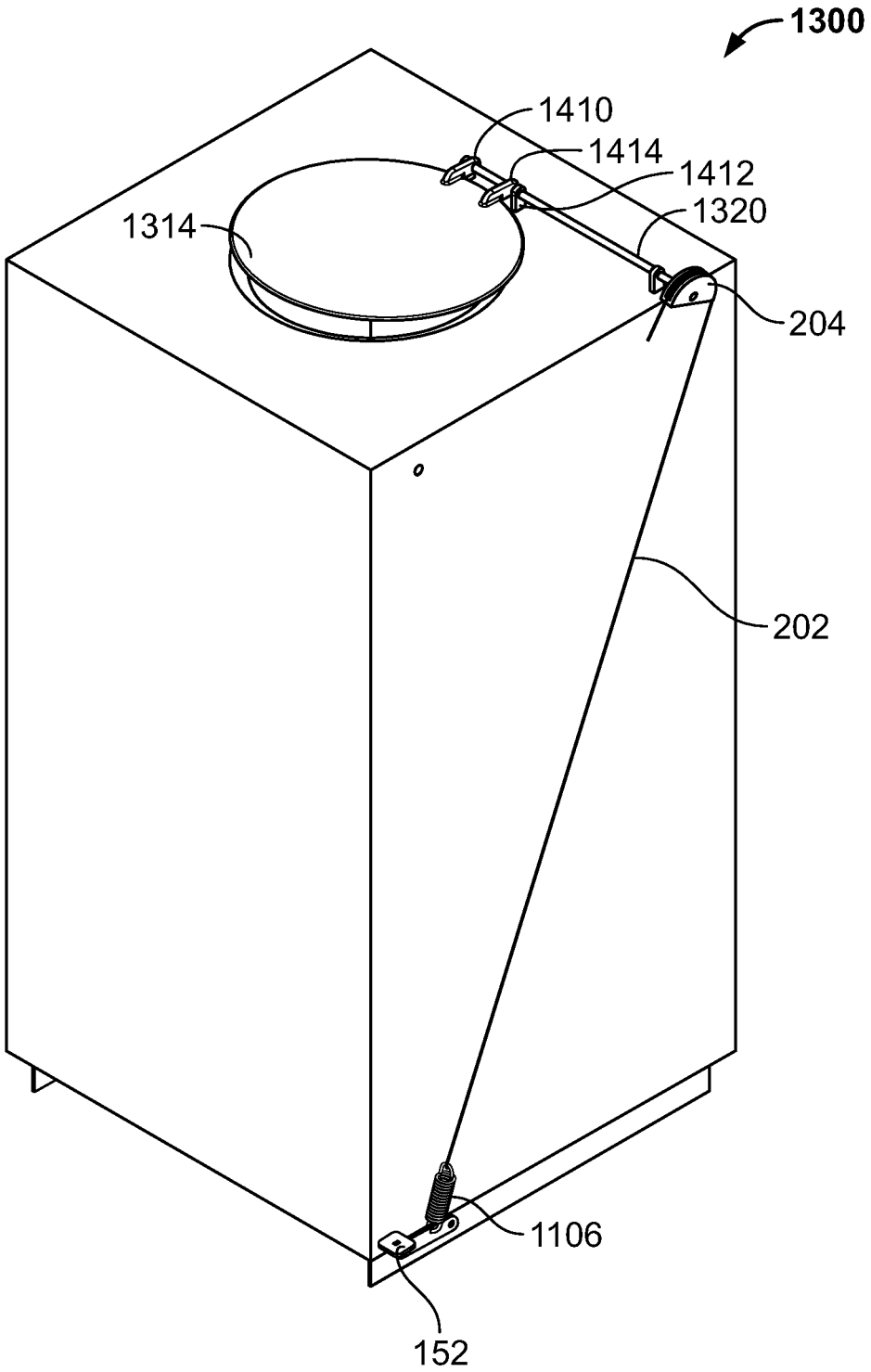
FIG. 14 is a schematic perspective view of the example waste receptacle shown in FIG. 13 in which details of some interior components are shown.

FIG. 14 is a schematic perspective view of the example waste receptacle 1300, in which housing 154 has been removed to permit viewing of internal components of door opener 150.

Door opener 150 includes foot pedal 152, spring 1106, force transfer device 202, coupling 204, arm 206, and a pair of door hinged joints 1410. Hinged joint 1410 includes a first hinge portion 1412 and a second hinge portion 1414. First hinge portion 1412 is mounted on the top side 110 of waste receptacle 1300 and includes an aperture, through which arm 1320 is inserted. Arm 1320 is arranged to freely rotate in the aperture of first hinge portion 1412. Second hinge portion 1414 is mounted on hinged door 1314 and on arm 1320. As discussed above, when foot pedal 152 is depressed, a force is transferred through force transfer device 202. The force is applied to coupling 204. In this example, coupling 204 is a cam with a channel on the top for force transfer device 202 to pass through. Coupling 204 has a set screw on the back for attachment of force transfer device 202. Arm 1320 is connected to coupling 204, and rotation of coupling 204 causes rotation of arm 1320 about the axis of the arm 1320.

When arm 1320 rotates, the force is transferred through arm 1320 to second hinge portion 1414 so that second hinge portion 1414 pivots about the axis of arm 1320 and causes the hinged door 1314 to open in the direction A2 shown in FIG. 13. Arm 1320 is preferably made of metal, such as a metal rod. First 1412 and second 1414 hinge portion is attached to the top side 110 and the hinged door 1314 respectively by means of fasteners, such as screws, nails, adhesives and the like.

Arm 1320 is an example of a door position adjustment device for moving door 1314 from a closed position to an open position, and from the open position to the closed position. In some embodiments, the door position adjustment device further includes one or more hinged joints 1410.

Figure 15:
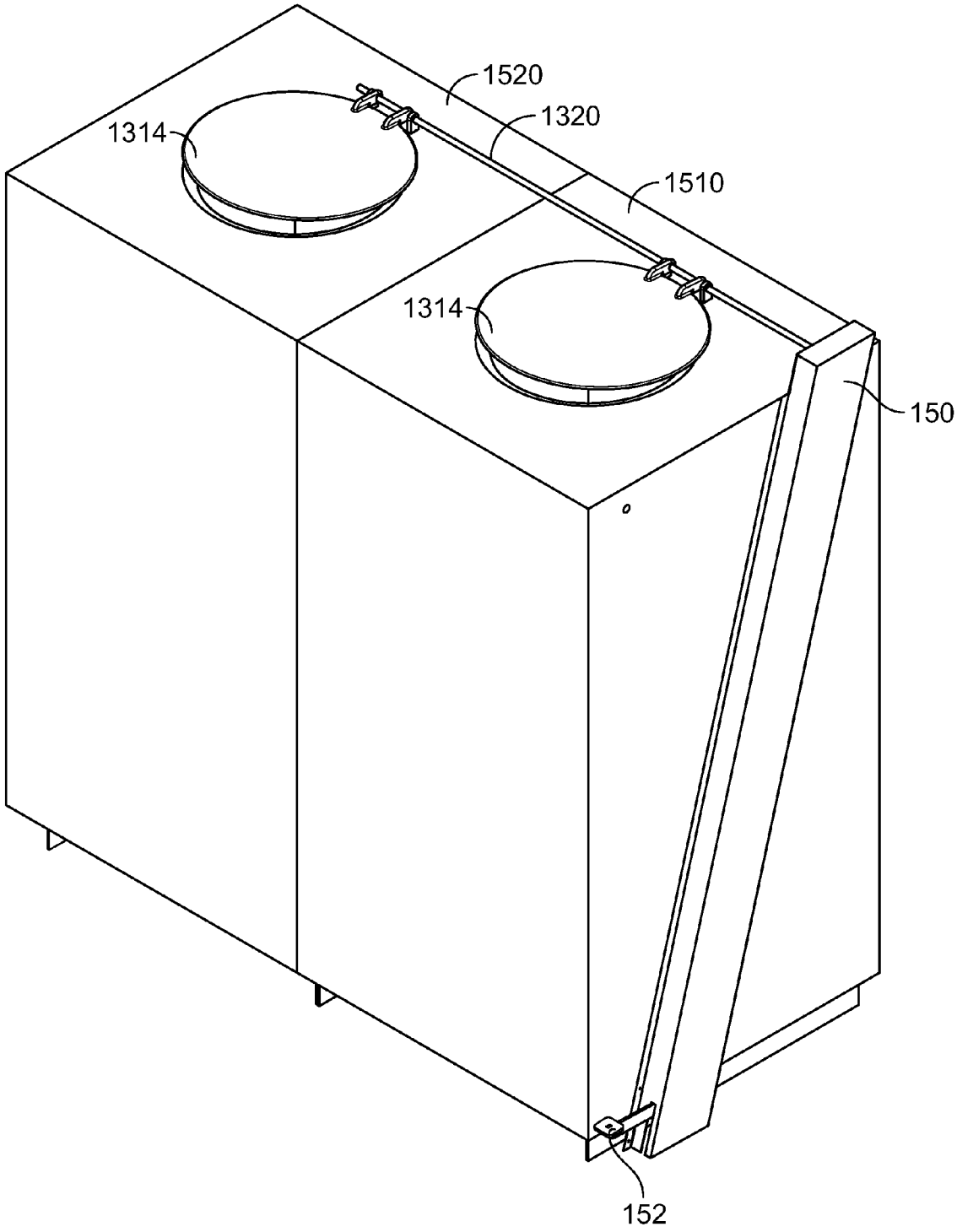
FIG. 15 is a schematic perspective view of another example waste receptacle.

FIG. 15 is schematic perspective view of another example, in which two waste receptacles 1510 and 1520 are being operated by one door opener 150. The basic structure and function of waste receptacles 1510 and 1520 is similar to waste receptacle 1300 shown in FIGS. 13-14 and is, thus, not described in detail. In this example hinged doors 1314 are both attached to arm 1320. Thus, when foot pedal 152 is depressed, arm 1320 rotates causing both hinged doors 1314 to open in the direction A2 shown in FIG. 13.

Some of the parts shown in the drawings are illustrated as being transparent to permit viewing of parts that would otherwise be obscured from view. For example, portions of FIGS. 2, 5, 6, 11, and 12 depict walls of the waste receptacles and portions of the housing as being transparent. As shown in other drawings, however, these portions will typically not be made of a transparent material. However, embodiments can be made from transparent material if desired.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A foot actuated door opener kit for assembly with a waste receptacle, the waste receptacle including an interior space arranged and configured to contain a waste basket therein, the kit comprising:

a foot pedal;

a door position adjustment device including an arm and a door connection bracket having an aperture therein, wherein the arm is arranged and configured to be connected to a door of the waste basket receptacle by a slidable connection with the aperture in the door connection bracket;

a force transfer device including a coupler, the force transfer device arranged and configured to be positioned outside of the waste receptacle, wherein when assembled, the force transfer device is connected between the foot pedal and the door position adjustment device, wherein a force generated by depressing the foot pedal is transferred to the coupler connected to the arm causing the coupler and the arm to rotate and move the door from a closed position to an open position; and a housing arranged and configured to be connected to an exterior side of the waste receptacle, wherein when assembled, the force transfer device is at least partially contained between the housing and the exterior side of the waste receptacle.

2. The kit of claim 1, further comprising at least one bracket and at least one fastener, the bracket including at least one fastener aperture, wherein when the kit is assembled with the waste receptacle, the fastener connects the bracket to the exterior of the waste receptacle and the bracket connects the housing to the exterior of the waste receptacle.

3. The kit of claim 1, wherein the arm has a bend therein, wherein when the kit is assembled with the waste receptacle, the coupler extends through an aperture formed in a side of the waste receptacle.

4. The kit of claim 1, wherein when the kit is assembled with the waste receptacle, the bracket is fastened to an interior surface of the door and the arm extends through the aperture.

* * * * *